US005977468A

United States Patent [19]

Fujii

[11] Patent Number: 5,977,468

[45] Date of Patent: Nov. 2, 1999

[54] MUSIC SYSTEM OF TRANSMITTING PERFORMANCE INFORMATION WITH STATE INFORMATION

[75] Inventor: Shigeki Fujii, Hamamatsu, Japan

[73] Assignee: Yamaha Corporation, Hamamatsu, Japan

[21] Appl. No.: 09/102,259

[22] Filed: Jun. 22, 1998

[30] Foreign Application Priority Data

Jun. 30, 1997 [JP] Japan ..... 9-174889

[51] Int. Cl.[6] ..... G10H 1/18; G10H 7/00

[52] U.S. Cl. ..... 84/609; 84/617; 84/645; 84/649; 84/655

[58] Field of Search ..... 84/609–614, 617, 84/645, 649–652, 655

[56] References Cited

U.S. PATENT DOCUMENTS

| | | | |
|---|---|---|---|
| 5,357,048 | 10/1994 | Sgroi | 84/645 |
| 5,361,673 | 11/1994 | Kira et al. | 84/645 X |
| 5,644,097 | 7/1997 | Shimada | 84/645 X |
| 5,744,740 | 4/1998 | Mizuno | 84/645 X |
| 5,753,844 | 5/1998 | Matsumoto | 84/645 X |
| 5,763,805 | 6/1998 | Yamabata et al. | 84/645 |

*Primary Examiner*—Stanely J. Witkowski
*Attorney, Agent, or Firm*—Pillsbury Madison & Sutro LLP

[57] ABSTRACT

A music system is constructed by a transmitter for transmitting performance information and a receiver for receiving the performance information so as to reproduce music performance. In the transmitter, a first packet encoder packetizes the performance information so as to sequentially form a primary packet of the performance information. A second packet encoder packetizes state information so as to form a secondary packet of the state information in correspondence with the primary packet. The state information indicates a proper operation state of a channel defined by the protocol of Musical Instrument Digital Interface. A packet multiplexer transmits the primary packet together with the secondary packet by multiplexing so as to ensure proper reproduction of the music performance by means of a channel provided in the receiver. In the receiver, a packet demultiplexer separates the primary packet and the secondary packet from each other. A first packet decoder has the channel of the Musical Instrument Digital Interface and responds to the separated primary packet for updating an current operation state of the channel so as to reproduce the music performance. A second packet decoder compares the updated current operation state with the proper operation state indicated by the separated secondary packet, and operates if the updated current operation state is different than the proper operation state for rewriting the current operation state according to the state information so as to properly reproduce the music performance according to the performance information.

13 Claims, 3 Drawing Sheets

MUSIC SYSTEM OF TRANSMITTING PERFORMANCE INFORMATION WITH STATE INFORMATION

BACKGROUND OF THE INVENTION

1. Field of the Invention

The present invention generally relates to a method of transmitting music performance information based on MIDI (Musical Instrument Digital Interface) protocol through a communication satellite or Internet.

2. Description of Related Art

Recently, various attempts have been made for real-time transmission of music performance information composed of MIDI messages in a digital broadcasting system based on the Internet or the communication satellite (CS). The digital broadcasting of this type requires a protocol in taking account of a transfer error. MIDI is designed with special emphasis placed on the real-time capability. Therefore, use of MIDI in a great transfer error rate environment causes many problems. Especially, a serious problem is that a music note remains sounded unintentionally due to dropout or missing of note-on information during transfer of the music performance information. Action that can be taken is to mute all sounds upon detection of a data drop and to restart sounding upon reception of new note-on information. However, this measure frequently causes music interruptions in an environment prone to transfer error, leading to degraded service.

In the broadcasting service for transmitting music performance information, it is desired that music performance information can be reproduced from a midpoint of a music piece. In MIDI, timbre setting information and sound source control information are transmitted at the beginning of the music piece. Therefore, starting reproduction of the music piece after transmission of these pieces of information may result in the reproduction of a sound different from intended condition. In MIDI, besides the past state of timbre information, the past state of control change information of a sustain pedal, for example, affects current music reproduction. Therefore, it is necessary for the halfway reproduction to take measures against this problem.

Further, the physical transfer rate of MIDI is 31.25 kbps. The substantial data rate of music performance information is often far lower than the physical transfer rate. In an environment of a limited transmission band, data rate reduction is also an important point. Therefore, it is necessary for the music performance information transmitting system to flexibly cope with any environment in which the transmission band varies real-time like the Internet.

Thus, the conventional music performance information transmitting system has the following three problems: (1) reproduction of music performance is seriously affected in an environment suffering from a high transfer error rate; (2) reception of music performance information from a midpoint in a music stream hinders reproduction of the music performance; and (3) no transmission can be made at a rate capable of clearing a predetermined transfer bit rate.

SUMMARY OF THE INVENTION

It is therefore an object of the present invention to provide a system of transmitting performance information capable of reproducing music performance without problem even if the performance information is received in an environment of a high transfer error rate or even if the performance information is received from a midpoint of a music stream, and capable of providing appropriate transmission control matching a transfer bit rate and contents of service.

An inventive system comprises a transmitter apparatus for transmitting performance information which is based on a protocol of Musical Instrument Digital Interface, and a receiver apparatus for receiving the performance information so as to reproduce music performance. The transmitter apparatus comprises first packet forming means for packetizing the performance information so as to sequentially form a primary packet of the performance information, second packet forming means for packetizing state information so as to form a secondary packet of the state information in correspondence with the primary packet, the state information indicating a proper operation state of a channel defined by the protocol of Musical Instrument Digital Interface at the time when reproduction of the music performance is started in response to the primary packet of the performance information, and multiplexing means for transmitting the primary packet of the performance information together with the secondary packet of the state information so as to ensure proper reproduction of the music performance at the receiver apparatus. The receiver apparatus comprises demultiplexing means for receiving the primary packet together with the secondary packet, and for separating the primary packet and the secondary packet from each other, and reproducing means having a channel of the Musical Instrument Digital Interface and responding to the separated primary packet for updating an current operation state of the channel so as to reproduce the music performance, the reproducing means comparing the updated current operation state with the proper operation state indicated by the separated secondary packet, and operating if the updated current operation state is different than the proper operation state for rewriting the current operation state of the channel according to the state information of the secondary packet so as to properly reproduce the music performance according to the performance information of the primary packet.

An inventive transmitter apparatus is constructed for transmitting performance information, which is based on a protocol of Musical Instrument Digital Interface to reproduce music performance through a remote channel defined by the protocol of Musical Instrument Digital Interface. The transmitter apparatus comprises first packet forming means for packetizing the performance information so as to sequentially form a primary packet of the performance information, second packet forming means for packetizing state information so as to form a secondary packet of the state information in correspondence with the primary packet of the performance information, the state information indicating a proper operation state of the remote channel at the time when reproduction of the music performance is started according to the primary packet of the performance information, and multiplexing means for transmitting the primary packet of the performance information together with the secondary packet of the state information so as to realize the reproduction of the music performance by means of the remote channel.

An inventive receiver apparatus is constructed for receiving performance information which is based on a protocol of Musical Instrument Digital Interface so as to reproduce music performance. The receiver apparatus comprises receiving means for receiving a primary packet containing the performance information together with a secondary packet containing state information which indicates a proper operation state of a channel defined by the protocol of Musical Instrument Digital Interface at the time when reproduction of the music performance is started according to the performance information of the primary packet, separating means for separating the primary packet of the performance information and the secondary packet of the state information from each other, and reproducing means for updating a current operation state of the channel according to the performance information contained in the separated primary packet for reproduction of the music performance by means of the channel, the reproducing means comparing the updated current operation state with the proper operation state indicated by the state information contained in the separated secondary packet, and operating if the updated current operation state is different than the proper operation state for rewriting the current operation state according to the state information so as to properly reproduce the music performance according to the performance information.

According to the invention, the transmitter apparatus or sending side sends a primary packet or music performance information packet together with a secondary packet or state information packet which is added appropriately to the music performance information packet. The receiver apparatus or receiving side updates its internal state by the received music performance information packet. Eventually, the receiver apparatus corrects this internal state by the content of the received state information packet. Consequently, if the music performance information is occasionally received from a midpoint in a stream of a music piece, the initial internal state of the receiver apparatus is rewritten by the content of the received state information packet, thereby instantly allowing the music performance information to be reproduced correctly. If there occurs a reception packet dropout, the internal state of the receiver apparatus may temporarily fail in a wrong state different from a right state. If this occurs, the internal state is returned to the right state upon receiving the state information packet. Until then, the previous right state is restored. Therefore, no state occurs in which music is interrupted, thereby preventing an environment of the high transfer error rate from seriously and adversely affecting the reproduced music in terms of auditory sensation.

Further, according to the invention, the state information packet is transmitted and attached to the music performance information packet as required. Consequently, the state information packets attached to the music performance information packets can be sent at a frequency according to a transmission band used and according to contents of service, thereby allowing proper transmission control matching a transfer bit rate and contents of service.

Expediently, the music performance information includes a MIDI event formed by a pair of note-on information and note-off information and note length information, the note-off information does not drop since the same is integrated into the MIDI event, thereby overcoming the above-mentioned problem that a note remains sounded without intention.

BRIEF DESCRIPTION OF THE DRAWINGS

These and other objects of the invention will be seen by reference to the description, taken in connection with the accompanying drawings, in which:

FIG. 2(*b*) is a diagram illustrating an example of a state information packet for use in the above-mentioned preferred embodiment.

DETAILED DESCRIPTION OF PREFERRED EMBODIMENTS

Figure 1:
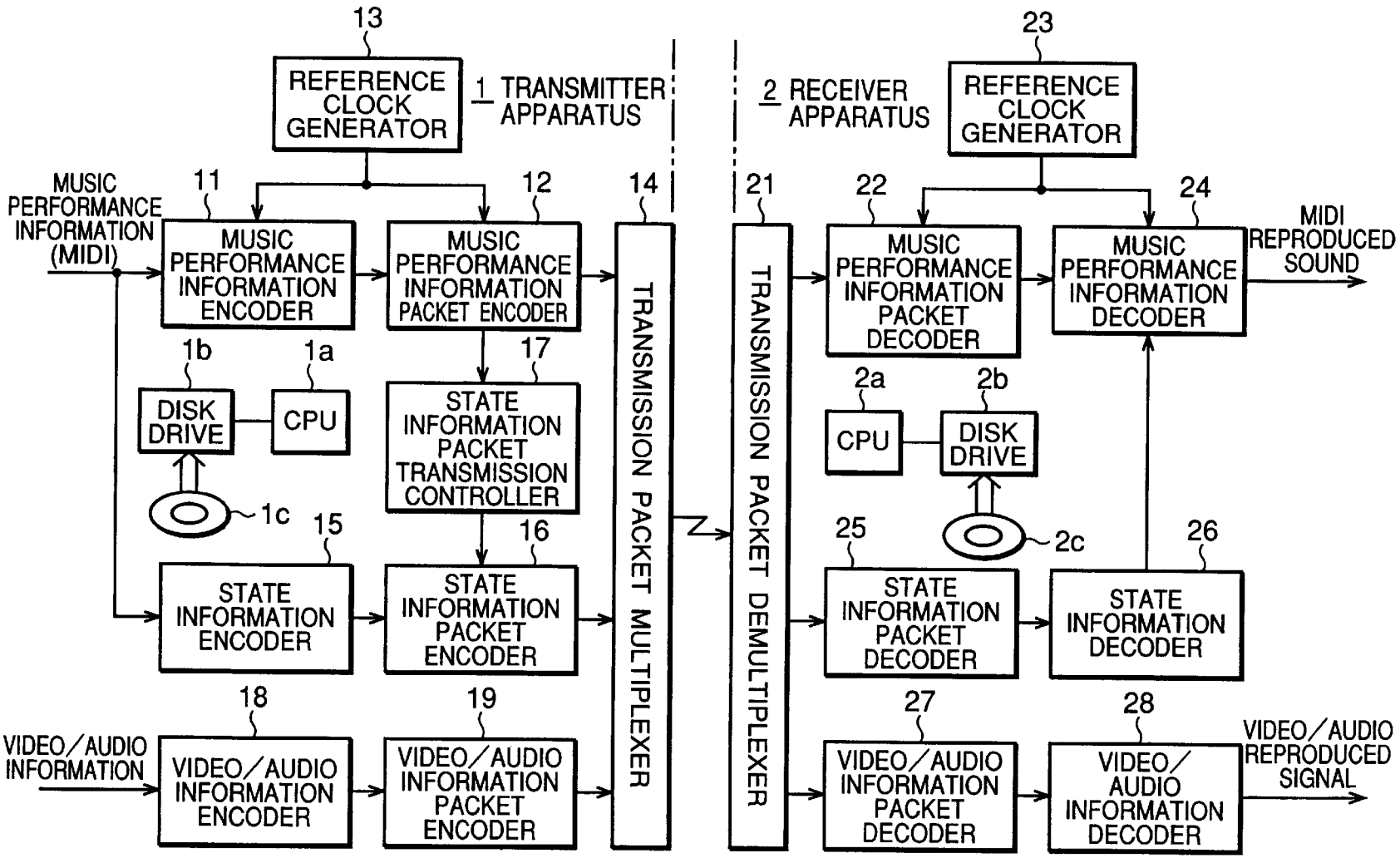
FIG. 1 is a block diagram illustrating a music performance information transmitting system practiced as one preferred embodiment of the invention.

This invention will be described in further detail by way of example with reference to the accompanying drawings. Now, referring to FIG. 1, there is shown a block diagram illustrating a music performance information transmitting system practiced as one preferred embodiment of the invention. As shown, music performance information composed of MIDI data is supplied to a transmitter apparatus 1. The music performance information is first inputted in a music performance information encoder 11, and is converted into event information and time difference information between temporally adjacent events. These converted pieces of information are inputted in a music performance information packet encoder 12 in the subsequent stage, and are packetized at a predetermined time interval. An example of a format of this music performance information packet is shown in FIG. 2(*a*). As shown, the music performance information packet is constituted by a packet header composed of a sync byte, a packet ID and so on, a packet data length indicative of the length of this packet, a packet reproduction start time recorded by referencing a reference clock coming from a reference clock generator 13, time difference information $\Delta T$ between adjacent events based on this reproduction start time, a sequence of MIDI events, and a CRC (Cyclic Redundancy Check) error correction code. This music performance information packet is sent to a transmission packet multiplexer 14, and is multiplexed with other information to be described later. The multiplexed packet is then sent to a receiver apparatus 2.

On the other hand, the music performance information is also sent to a state information encoder 15. The state information encoder 15 generates from the music performance information the timbre information, note-on/off state, and volume state of each MIDI channel, and sequentially updates these pieces of generated information. These pieces of generated information are supplied to a state information packet encoder 16. The state information packet encoder 16 packetizes the state information of the time at which reproduction of each packet generated by the music performance information packet encoder 12 starts. An example of a format of this state information packet is shown in FIG. 2(*b*). As shown, the state information packet is constituted by a packet header composed of a sync byte, a packet ID and so on, a packet data length indicative of the length of this packet, a packet reproduction start time, timbre numbers and note-on/off states of channels, other state information, and a CRC.

This state information packet is generated in correspondence with each music performance information packet. However, whether to actually send a generated state information packet is determined by a state information packet transmission controller 17 by considering a mean data rate, default send timing, and so on. It is important for the packet transmission controller 17 to execute control while simulating the sending operation in the transmitter apparatus 1 such that basically the data on the receiver apparatus 2 does not underflow or overflow. In addition, the sending of a state information packet may be controlled according to required service, data quality, and transfer rate. For example, with a system that requires to quickly execute halfway reproduction of music, the frequency of the sending must be raised over the conventional frequency. With a system restricted in the upper limit of the transfer rate, additional information such as a state information packet cannot be inserted at higher rates. Likewise, with a system required to maintain the average transfer rate at a constant level, it is necessary to execute the sending control while monitoring the actual rate.

In addition, in the transmitter apparatus 1, video/audio information based on a video signal and an audio signal is compressed and encoded by a video/audio information encoder 18. The compressed and encoded video/audio information is packetized by a video/audio information packet encoder 19, and the resultant packet is supplied to the transmission packet multiplexer 14. The transmission packet multiplexer 14 multiplexes the music performance information packet, the state information packet, and the video/audio information packet, and sends the multiplexed packets to the receiver apparatus 2.

In the receiver apparatus 2, the multiplexed packets sent from the transmitter apparatus 1 are demultiplexed by a demultiplexer 21 into the music performance information packet, the state information packet, and the audio/video information packet. The music performance packet is supplied to a music performance packet decoder 22. The packet decoder 22 generates sequence information composed of MIDI events based on the packet reproduction start time and the time difference information $\Delta T$ between adjacent events. In doing so, a reference clock for providing time reference for MIDI sequence information is supplied from a reference clock generator 23 to the decoder 22. This MIDI sequence information is supplied to a music performance information decoder 24 to be restored into an audio signal.

The state information packet demultiplexed by the transmission packet demultiplexer 21 is supplied to a state information packet decoder 25. The state information packet decoder 25 arranges in time sequence the state information of each channel contained in the state information packet based on the packet reproduction start time, and supplies the resultant channel state information to a state information decoder 26. The state information decoder 26 takes each state information at the time when reproduction of each packet starts, from the time sequence of the channel state information supplied from the decoder 25, and supplies this state information to the music performance information decoder 24 in synchronization with the music performance information. The music performance information decoder 24 compares the internal state sequentially updated by the music performance information with the state information given on a packet basis from the state information decoder 26. If mismatch is found, the decoder 24 rewrites the internal state with the state information supplied from the decoder 26.

Further, the video/audio packet demultiplexed by the transmission packet demultiplexer 21 is sequentially decoded by a video/audio information packet decoder 27 and a video/audio information decoder 28 to be outputted as a video/audio reproduced signal.

Referring again to FIG. 1, the inventive music system is comprised of the transmitter apparatus 1 for transmitting performance information which is based on a protocol of Musical Instrument Digital Interface, and the receiver apparatus 2 for receiving the performance information so as to reproduce music performance. In the transmitter apparatus 1, first packet forming means is provided in the form of the performance information packet encoder 12 for packetizing the performance information so as to sequentially form a primary packet of the performance information. Second packet forming means is provided in the form of the state information packet encoder 16 for packetizing state information so as to form a secondary packet of the state information in correspondence with the primary packet. The state information indicates a proper operation state of a channel defined by the protocol of Musical Instrument Digital Interface at the time when reproduction of the music performance is started in response to the primary packet of the performance information. Further, multiplexing means is provided in the form of the transmission packet multiplexer 14 for transmitting the primary packet of the performance information together with the secondary packet of the state information so as to ensure proper reproduction of the music performance at the receiver apparatus 2. In the receiver apparatus 2, demultiplexing means is provided in the form of the transmission packet demultiplexer 21 for receiving the primary packet together with the secondary packet, and for separating the primary packet and the secondary packet from each other. Reproducing means includes the performance information decoder 24 having a channel of the Musical Instrument Digital Interface and responding to the separated primary packet for updating an current operation state of the channel so as to reproduce the music performance. The reproducing means further includes the state information decoder 26 for comparing the updated current operation state with the proper operation state indicated by the separated secondary packet, and operates if the updated current operation state is different than the proper operation state for rewriting the current operation state of the channel according to the state information of the secondary packet so as to properly reproduce the music performance according to the performance information of the primary packet.

Preferably, the first packet forming means packetizes the performance information which indicates a sequence of note-on events and note-off events. The second packet forming means packetizes the state information which indicates a sequence of note-on states and note-off states in correspondence with the sequence of the note-on events and the note-off events so that the channel turns to the note-on state from the note-off state in response to the note-on event and the channel turns to the note-off state from the note-on state in response to the note-off event. In such a case, the reproducing means sequentially updates the current state of the channel in terms of the note-on state and the note-off state according to the corresponding note-on event and the note-off event. The reproducing means operates if the updated current state is different than the proper state indicated by the state information of the secondary packet due to transfer error of the performance information of the primary packet for rewriting the current state of the channel according to the state information so as to properly reproduce the music performance according to the performance information.

Preferably, the first packet forming means packetizes the performance information which indicates a sequence of note events. The second packet forming means packetizes the state information which contains timbre information which determines a timbre of each note event. In such a case, the reproducing means operates if the timbre currently set in the channel is different than the timbre indicated by the timbre information contained in the secondary packet for rewriting the timbre of the channel according to the timbre information of the secondary packet so as to properly reproduce each note event of the music performance.

Preferably, the multiplexing means transmits each of the primary packets at a stable rate, and transmits each of the secondary packets at a variable rate so as to avoid overflow and underflow of information processing at the receiver apparatus 2.

Expediently, the first packet forming means may packetize the performance information, which indicates a sequence of note events. As will be described later in conjunction with FIG. 3, each note event has a note length defined by each pair of a note-on event and a note-off event according to the protocol of Musical Instrument Digital Interface.

According to the inventive system constituted as described above, the music performance information packet and the state information packet are sent as a pair of packet data. Consequently, even if the music performance information is received from some midpoint in a stream of a music piece, the state information packet is referenced to correctly reproduce the music performance information for each channel at that point of time.

If a dropout of a received packet occurs on a transmission path having a high transfer error rate, there may be raised one of the following three dropout modes:

| Mode | n-th music performance information packet | (n + 1)-th state information packet |
|---|---|---|
| (1) | No | Yes |
| (2) | Yes | No |
| (3) | No | No |

In mode (1) above, the internal state of the music performance information decoder 24 is forcefully rewritten with the state information packet (n+1) corresponding to a packet next to the dropped music performance information packet (n), thereby continuing reproduction of packet (n+2) and subsequent packets without trouble.

In mode (2) above, the internal state of the music performance information decoder 24 may only be updated by the received music performance information packet, thereby not affecting the music reproduction at all.

In mode (3) above, the current state may only be maintained until a next music performance information packet or a next state information packet is received. In this case, the same internal state continues for one or several packets. However, because this continued period is generally short, it presents less sense of disagreement in auditory sensation than the case in which a sound is interrupted.

In any mode, the internal state of the music performance information decoder 24 is updated every time a music performance information packet is received. Moreover, this internal state is compared with the content of a subsequently received state information packet. If a mismatch is found, the internal state of the decoder 24 may only be rewritten with the content of the state information packet.

The following describes more detailed flows of processing operation for forcefully rewriting the internal state upon occurrence of a transmission error.

Operation 1: Recovering Program Change Information

Program change information is timbre information to be set for each MIDI channel. Normally, timbre setting is executed at the beginning of a music piece for each channel to be used. Sometimes, timbre change may be executed halfway through the music piece. If this program change information drops out, the music performance is executed in a timbre different from the intended timbre. If the internal state of the decoder 24 differs from the state indicated by the state information packet, a program change event is immediately issued so that the timbre to be performed matches the timbre indicated by the state information packet, thereby changing the internal state of the decoder 24. If a timbre differs from the forcefully updated timbre and there is an already sounded note, the different timbre may be muted.

Operation 2: Recovering Note State

First, when a state information packet is received, the internal state indicative of note-on/note-off of note numbers 0 through 127 is compared with a note-on/note-off state indicated by the state information packet for each MIDI channel. The following four combinations are possible.

| Mode | Internal state | State indicated by state information packet |
|---|---|---|
| (1) | OFF | OFF |
| (2) | OFF | ON |
| (3) | ON | OFF |
| (4) | ON | ON |

In modes (1) and (4) above, the note-on/note-off states match each other, hence no processing is required, especially. In mode (2) above, it is determined that a music performance information packet has dropped out before receiving the current state information packet. In such a situation, the following two cases are possible.

(a) The note-on event of a corresponding note number is forcefully generated to match the internal state of the decoder 24 with the state indicated by the state information packet. In this method, the dropout may be perceived as a delay in sounding timing, giving an adverse affect in terms of auditory sensation.

(b) The information of the state information packet is ignored, executing no processing in particular. In this method, that note is not being sounded, so that, it is determined that no much sense of disagreement is caused even if the note is not forcefully sounded. However, if that note is musically important, it may sound unnatural. In terms of processing, this method is simpler than the method of (a) above.

In mode (3), it is determined that the music performance information packet including the note-off event of that note number has dropped out. In this case, it is effective in terms of auditory sensation to forcefully stop sounding for that note number, thereby matching the internal state of the decoder 24 with the state indicated by the state information packet.

Operation 3: Recovering Control Change Information

Control change information is performance control information represented by volume and sustain pedal to be set for each MIDI channel. Generally, dropout of control change information is determined to have a less affect in terms of auditory sensation than the two pieces of information mentioned above. If this happens, however, forceful change should be executed immediately. In terms of processing, a control change event is internally generated such that a match is found with the state indicated by the state information packet.

Figure 3:
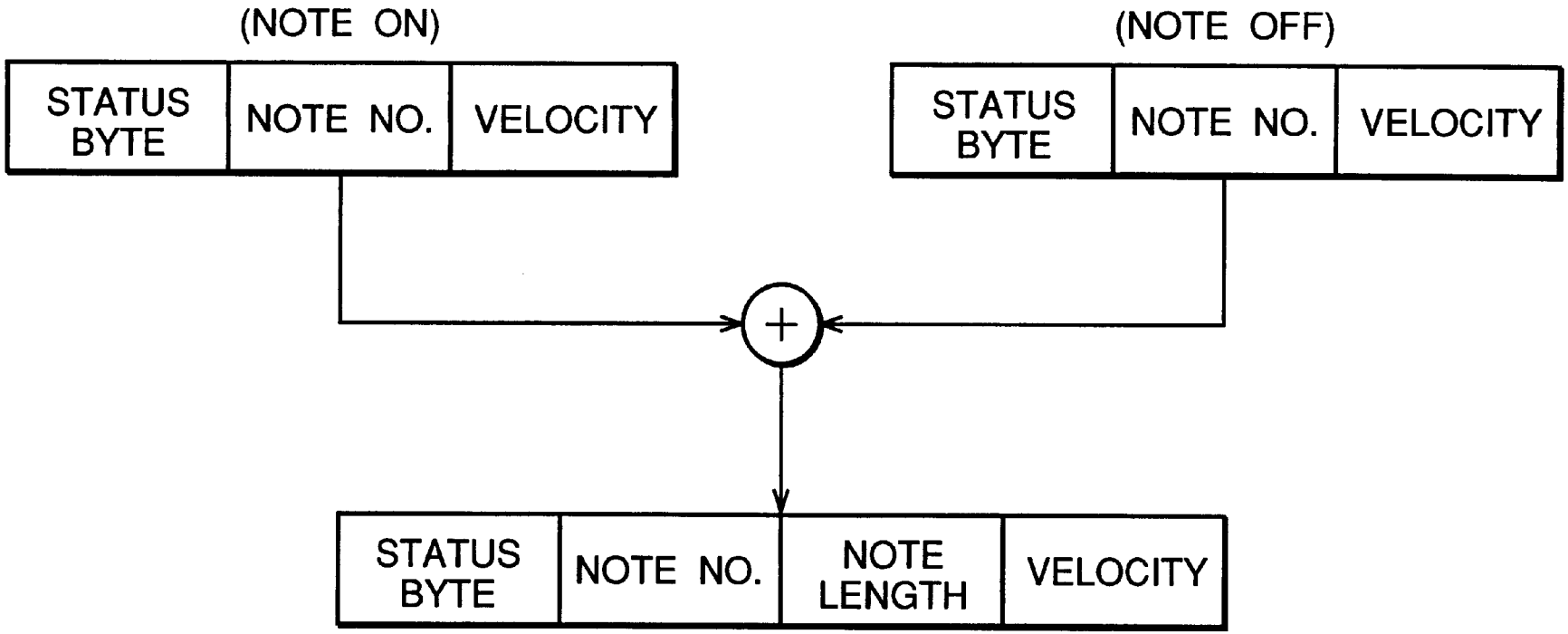
FIG. 3 is a diagram illustrating an example of a format of a MIDI event contained in the above-mentioned music performance information packet.

It should be noted that, in the music performance information packet, a MIDI message is sent upon occurrence of an event such as note-on or note-off; therefore, if a note-off event drops out in the receiver apparatus after occurrence of a note-on event, the note remains sounding unintentionally until a next state information packet is received. To prevent this problem from occurring in a system where already recorded sequence information is transmitted real-time, a pair of note-on message and note-off message is detected beforehand as shown in FIG. 3, and this pair is converted into data of a note-on information (note number) format and a sound duration format. Then, the converted data is transmitted by a packet according to the invention. Consequently, at least note-off information does not drop out by itself, thereby preventing the problem that a note remains sounded unintentionally.

Referring back again to FIG. 1, the transmitter apparatus 1 may be composed of a personal computer having a CPU 1*a* for controlling various units of the transmitter apparatus 1 and a disk drive 1*b* for receiving a machine readable medium 1*c* such as a floppy disk. The machine readable medium 1*c* is for use in the transmitter apparatus 1 having the CPU 1*a* and transmitting performance information which is based on a protocol of Musical Instrument Digital Interface to reproduce music performance through a remote channel defined by the protocol of Musical Instrument Digital Interface. The medium 1*c* contains program instructions executable by the CPU la for causing the apparatus 1 to perform the steps of packetizing the performance information so as to sequentially form a primary packet of the performance information, packetizing state information so as to form a secondary packet of the state information in correspondence with the primary packet of the performance information, the state information indicating a proper operation state of the remote channel at the time when reproduction of the music performance is started according to the primary packet of the performance information, and transmitting the primary packet of the performance information together with the secondary packet of the state information so as to realize the reproduction of the music performance by means of the remote channel.

Figure 2A:
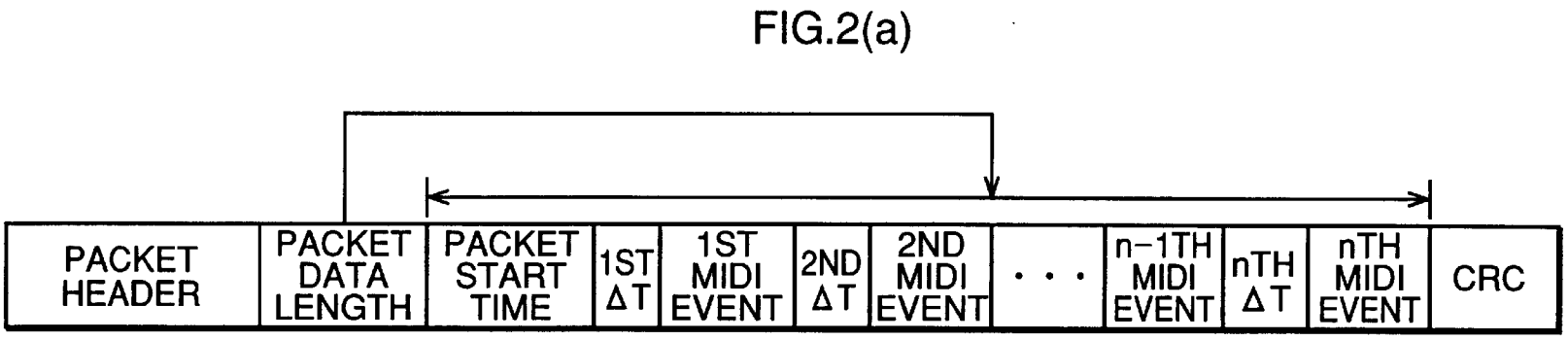
FIG. 2(*a*) is a diagram illustrating an example of a music performance information packet for use in the above-mentioned preferred embodiment.
Figure 2B:
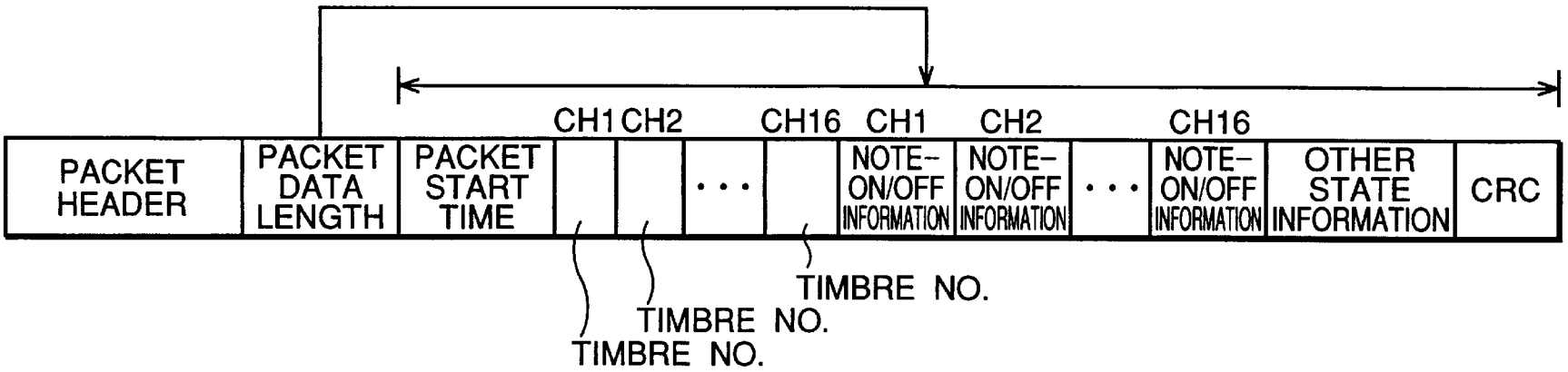

Referring further to FIG. 1, the receiver apparatus 2 may be composed of a personal computer having a CPU 2*a* for controlling various units of the receiver apparatus 2 and a disk drive 2*b* for receiving a machine readable medium 2*c* such as a floppy disk. The machine readable medium 2*c* is for use in the receiver apparatus 2 having the CPU 2*a* and receiving performance information which is based on a protocol of Musical Instrument Digital Interface so as to reproduce music performance. The medium 2*a* contains program instructions executable by the CPU 2*a* for causing the receiver apparatus 2 to perform the steps of receiving a primary packet containing the performance information together with a secondary packet containing state information which indicates a proper operation state of a channel defined by the protocol of Musical Instrument Digital Interface at the time when reproduction of the music performance is started according to the performance information of the primary packet, separating the primary packet of the performance information and the secondary packet of the state information from each other, updating a current operation state of the channel according to the performance information contained in the separated primary packet for reproduction of the music performance by means of the channel, comparing the updated current operation state with the proper operation state indicated by the state information contained in the separated secondary, packet, and rewriting the current operation state according to the state information if the updated current operation state is different than the proper operation state so as to properly reproduce the music performance according to the performance information.

As described and according to the invention, the transmitter apparatus or sending side sends a music performance information packet with a state information packet which is added appropriately. The receiving side, while updating its internal state by the received music performance information packet, corrects this internal state by the content of the received state information packet. Consequently, even if the music performance information has been received from some midpoint in a stream of a music piece, the initial internal state of the receiving side is rewritten by the content of the received state information packet, thereby immediately allowing the music performance information to be reproduced correctly. If there occurs a reception packet dropout, the internal state of the receiving side may be temporarily placed in a state different from the inherent state. If this occurs, the internal state is returned to the inherent state upon receiving the state information packet. Until then, the previous state is maintained. Therefore, no state in which music is interrupted occurs, thereby preventing an environment of high transfer error rate from seriously and adversely affecting the reproduced music in terms of auditory sensation. Further, according to the invention, a state information packet is transmitted and attached to a music performance information packet as required. Consequently, the state information packets attached to the music performance information packets can be transmitted at a frequency according to a transmission band used and contents of service, thereby realizing proper transmission control matching a transfer bit rate and contents of service.

While the preferred embodiments of the present invention have been described using specific terms, such description is for illustrative purposes only, and it is to be understood that changes and variations may be made without departing from the spirit or scope of the appended claims.

What is claimed is:

1. A system comprising a transmitter apparatus for transmitting performance information which is based on a protocol of Musical Instrument Digital Interface, and a receiver apparatus for receiving the performance information so as to reproduce music performance, wherein the transmitter apparatus comprises:

first packet forming means for packetizing the performance information so as to sequentially form a primary packet of the performance information;

second packet forming means for packetizing state information so as to form a secondary packet of the state information in correspondence with the primary packet, the state information indicating a proper operation state of a channel defined by the protocol of Musical Instrument Digital Interface at the time when reproduction of the music performance is started in response to the primary packet of the performance information; and multiplexing means for transmitting the primary packet of the performance information together with the secondary packet of the state information so as to ensure proper reproduction of the music performance at the receiver apparatus, and wherein the receiver apparatus comprises:

demultiplexing means for receiving the primary packet together with the secondary packet, and separating the primary packet and the secondary packet from each other; and reproducing means having a channel of the Musical Instrument Digital Interface and responding to the separated primary packet for updating an current operation state of the channel so as to reproduce the music performance, the reproducing means comparing the updated current operation state with the proper operation state indicated by the separated secondary packet, and operating if the updated current operation state is different than the proper operation state for rewriting the current operation state of the channel according to the state information of the secondary packet so as to properly reproduce the music performance according to the performance information of the primary packet.

2. The system according to claim 1, wherein the first packet forming means packetizes the performance information which indicates a sequence of note-on events and note-off events, and wherein the second packet forming means packetizes the state information which indicates a sequence of note-on states and note-off states in correspondence with the sequence of the note-on events and the note-off events so that the channel turns to the note-on state from the note-off state in response to the note-on event and the channel turns to the note-off state from the note-on state in response to the note-off event.

3. The system according to claim 2, wherein the reproducing means sequentially updates the current state of the channel in terms of the note-on state and the note-off state according to the corresponding note-on event and the note-off event, the reproducing means operating if the updated current state is different than the proper state indicated by the state information of the secondary packet due to transfer error of the performance information of the primary packet for rewriting the current state of the channel according to the state information so as to properly reproduce the music performance according to the performance information.

4. The system according to claim 1, wherein the first packet forming means packetizes the performance information which indicates a sequence of note events, and wherein the second packet forming means packetizes the state information which contains timbre information which determines a timbre of each note event.

5. The system according to claim 4, wherein the reproducing means operates if the timbre currently set in the channel is different than the timbre indicated by the timbre information contained in the secondary packet for rewriting the timbre of the channel according to the timbre information of the secondary packet so as to properly reproduce each note event of the music performance.

6. The system according to claim 1, wherein the multiplexing means transmits each of the primary packets at a stable rate, and transmits each of the secondary packets at a variable rate so as to avoid overflow and underflow of information processing at the receiver apparatus.

7. The system according to claim 1, wherein the first packet forming means packetizes the performance information which indicates a sequence of note events, each note event having a note length defined by each pair of a note-on event and a note-off event according to the protocol of Musical Instrument Digital Interface.

8. An apparatus for transmitting performance information which is based on a protocol of Musical Instrument Digital Interface to reproduce music performance through a remote channel defined by the protocol of Musical Instrument Digital Interface, the apparatus comprising:

first packet forming means for packetizing the performance information so as to sequentially form a primary packet of the performance information;

second packet forming means for packetizing state information so as to form a secondary packet of the state information in correspondence with the primary packet of the performance information, the state information indicating a proper operation state of the remote channel at the time when reproduction of the music performance is started according to the primary packet of the performance information; and multiplexing means for transmitting the primary packet of the performance information together with the secondary packet of the state information so as to realize the reproduction of the music performance by means of the remote channel.

9. An apparatus for receiving performance information which is based on a protocol of Musical Instrument Digital Interface so as to reproduce music performance, the apparatus comprising:

receiving means for receiving a primary packet containing the performance information together with a secondary packet containing state information which indicates a proper operation state of a channel defined by the protocol of Musical Instrument Digital Interface at the time when reproduction of the music performance is started according to the performance information of the primary packet;

separating means for separating the primary packet of the performance information and the secondary packet of the state information from each other; and reproducing means for updating a current operation state of the channel according to the performance information contained in the separated primary packet for reproduction of the music performance by means of the channel, the reproducing means comparing the updated current operation state with the proper operation state indicated by the state information contained in the separated secondary packet, and operating if the updated current operation state is different than the proper operation state for rewriting the current operation state according to the state information so as to properly reproduce the music performance according to the performance information.

10. A system comprising a transmitter for transmitting performance information which is based on a protocol of Musical Instrument Digital Interface, and a receiver for receiving the performance information so as to reproduce music performance, wherein the transmitter comprises:

a first packet encoder that packetizes the performance information so as to sequentially form a primary packet of the performance information;

a second packet encoder that packetizes state information so as to form a secondary packet of the state information in correspondence with the primary packet, the state information indicating a proper operation state of a channel defined by the protocol of Musical Instrument Digital Interface at the time when reproduction of the music performance is started in response to the primary packet of the performance information; and a packet multiplexer that transmits the primary packet of the performance information together with the secondary packet of the state information by multiplexing so as to ensure proper reproduction of the music performance by means of a channel provided in the receiver, and wherein the receiver comprises:

a packet demultiplexer that receives the primary packet together with the secondary packet, and that separates the primary packet and the secondary packet from each other;

a first packet decoder that has the channel of the Musical Instrument Digital Interface and responds to the separated primary packet for updating an current operation state of the channel so as to reproduce the music performance; and a second packet decoder that compares the updated current operation state with the proper operation state indicated by the separated secondary packet, and that operates if the updated current operation state is different than the proper operation state for rewriting the current operation state of the channel according to the state information of the secondary packet so as to properly reproduce the music performance according to the performance information of the primary packet.

11. A method of transferring performance information in a system comprised of a transmitter for transmitting the performance information which is based on a protocol of Musical Instrument Digital Interface, and a receiver for receiving the performance information so as to reproduce music performance, the method comprising the steps of:

packetizing the performance information in the transmitter so as to sequentially form a primary packet of the performance information;

packetizing state information in the transmitter so as to form a secondary packet of the state information in correspondence with the primary packet, the state information indicating a proper operation state of a channel defined by the protocol of Musical Instrument Digital Interface at the time when reproduction of the music performance is started in response to the primary packet of the performance information;

transmitting the primary packet of the performance information together with the secondary packet of the state information from the transmitter so as to ensure proper reproduction of the music performance by means of a channel provided in the receiver;

receiving the primary packet together with the secondary packet by the receiver;

separating the primary packet and the secondary packet from each other in the receiver;

operating the channel of the Musical Instrument Digital Interface in response to the separated primary packet for updating an current operation state of the channel so as to reproduce the music performance;

comparing the updated current operation state with the proper operation state indicated by the separated secondary packet; and rewriting the current operation state of the channel according to the state information of the secondary packet if the updated current operation state is different than the proper operation state so as to properly reproduce the music performance according to the performance information of the primary packet.

12. A machine readable medium for use in an apparatus having a CPU and transmitting performance information which is based on a protocol of Musical Instrument Digital Interface to reproduce music performance through a remote channel defined by the protocol of Musical Instrument Digital Interface, the medium containing program instructions executable by the CPU for causing the apparatus to perform the steps of:

packetizing the performance information so as to sequentially form a primary packet of the performance information;

packetizing state information so as to form a secondary packet of the state information in correspondence with the primary packet of the performance information, the state information indicating a proper operation state of the remote channel at the time when reproduction of the music performance is started according to the primary packet of the performance information; and transmitting the primary packet of the performance information together with the secondary packet of the state information so as to realize the reproduction of the music performance by means of the remote channel.

13. A machine readable medium for use in an apparatus having a CPU and receiving performance information which is based on a protocol of Musical Instrument Digital Interface so as to reproduce music performance, the medium containing program instructions executable by the CPU for causing the apparatus to perform the steps of:

receiving a primary packet containing the performance information together with a secondary packet containing state information which indicates a proper operation state of a channel defined by the protocol of Musical Instrument Digital Interface at the time when reproduction of the music performance is started according to the performance information of the primary packet;

separating the primary packet of the performance information and the secondary packet of the state information from each other;

updating a current operation state of the channel according to the performance information contained in the separated primary packet for reproduction of the music performance by means of the channel;

comparing the updated current operation state with the proper operation state indicated by the state information contained in the separated secondary packet; and rewriting the current operation state according to the state information if the updated current operation state is different than the proper operation state so as to properly reproduce the music performance according to the performance information.

* * * * *